US011471746B2

(12) United States Patent
St. Vincent

(10) Patent No.: US 11,471,746 B2
(45) Date of Patent: Oct. 18, 2022

(54) FINGER GUARD FOR GOALIE HOCKEY STICK

(71) Applicant: Guy St. Vincent, Ste Anne (CA)

(72) Inventor: Guy St. Vincent, Ste Anne (CA)

( * ) Notice: Subject to any disclaimer, the term of this patent is extended or adjusted under 35 U.S.C. 154(b) by 100 days.

(21) Appl. No.: 16/749,310

(22) Filed: Jan. 22, 2020

(65) Prior Publication Data

US 2020/0269124 A1 Aug. 27, 2020

Related U.S. Application Data

(60) Provisional application No. 62/808,499, filed on Feb. 21, 2019.

(51) Int. Cl.

| | |
|---|---|
| ***A63B 71/14*** | (2006.01) |
| ***A63B 60/06*** | (2015.01) |
| ***A63B 102/24*** | (2015.01) |
| ***A63B 59/70*** | (2015.01) |

(52) U.S. Cl.

CPC ..... *A63B 71/14* (2013.01); *A63B 60/06* (2015.10); *A63B 59/70* (2015.10); *A63B 2102/24* (2015.10)

(58) Field of Classification Search

CPC ..... A63B 59/00; A63B 60/42; A63B 69/00; A63B 71/14

See application file for complete search history.

(56) References Cited

U.S. PATENT DOCUMENTS

| | | | | |
|---|---|---|---|---|
| 3,533,630 | A * | 10/1970 | Monaco | A63B 60/34 473/206 |
| 3,940,134 | A * | 2/1976 | Bieganowski | A63B 59/70 473/299 |
| 4,340,224 | A * | 7/1982 | Staats | A63B 59/70 473/563 |
| 4,364,560 | A * | 12/1982 | Gemmel | A63B 69/0026 473/437 |
| 9,421,441 | B2 * | 8/2016 | Cross | A63B 60/34 |
| 9,463,365 | B2 * | 10/2016 | Brenner | A63B 59/70 |
| 9,500,464 | B2 * | 11/2016 | Coza | G01R 33/0035 |
| 9,586,112 | B2 * | 3/2017 | Sola | A63B 60/06 |
| 9,610,188 | B2 * | 4/2017 | Walsh | A63B 53/10 |
| 9,616,600 | B2 * | 4/2017 | Avnery | B29C 43/36 |
| 9,687,706 | B1 * | 6/2017 | Cormier | A63B 60/12 |
| 9,814,928 | B2 * | 11/2017 | Taylor | A63B 21/0058 |
| 2004/0138012 | A1 * | 7/2004 | Tyler | A63B 59/70 473/464 |
| 2006/0217218 | A1 * | 9/2006 | Ponzini | A63B 59/70 473/568 |

(Continued)

*Primary Examiner* — Eugene L Kim
*Assistant Examiner* — Christopher Glenn
(74) *Attorney, Agent, or Firm* — Ryan W. Dupuis; Kyle R. Satterthwaite; Ade & Company Inc.

(57) ABSTRACT

A finger guard for use with a goalie hockey stick includes a collar arranged to be frictionally retained about the paddler portion of the goalie hockey stick and a guard body on the collar so as to be supported on the paddle portion of the goalie hockey stick in proximity to the top end of the paddle portion to protrude outwardly from a major front face of the paddle portion. The guard body has a bottom face which is arranged to be oriented substantially perpendicularly to the common plane of the paddle portion. The guard body provides the function of deflecting pucks away from the fingers of the goalie even when pucks are deflected upwardly along the paddle portion of the goalie hockey stick.

12 Claims, 5 Drawing Sheets

(56) References Cited

U.S. PATENT DOCUMENTS

| | | | | |
|---|---|---|---|---|
| 2007/0275795 | A1* | 11/2007 | Barkume | A63B 69/0026 473/446 |
| 2014/0094329 | A1* | 4/2014 | Taylor | A63B 59/20 473/563 |
| 2015/0375072 | A1* | 12/2015 | Brenner | A63B 60/10 473/560 |
| 2016/0303463 | A1* | 10/2016 | Vaughn | A63B 71/143 |
| 2017/0319924 | A1* | 11/2017 | Nalbandian | A63B 60/42 |
| 2017/0326423 | A1* | 11/2017 | Kozac | A63B 60/06 |
| 2018/0001183 | A1* | 1/2018 | Tran | A63B 24/0062 |
| 2018/0110299 | A1* | 4/2018 | Kokkoris | A41B 11/00 |
| 2018/0333622 | A1* | 11/2018 | Plante | A63B 59/70 |
| 2018/0369668 | A1* | 12/2018 | King | A63B 60/06 |
| 2020/0000174 | A1* | 1/2020 | Plance | B60R 13/00 |
| 2020/0306602 | A1* | 10/2020 | Ducharme | G09B 19/0038 |
| 2022/0161109 | A1* | 5/2022 | Plante | A63B 60/12 |

* cited by examiner

FINGER GUARD FOR GOALIE HOCKEY STICK

This application claims the benefit under 35 U.S.C. 119(e) of U.S. provisional application Ser. No. 62/808,499, filed Feb. 21, 2019.

FIELD OF THE INVENTION

The present invention relates to a finger guard for use on the paddle portion of a goalie hockey stick to protect fingers of the goalie from puck impacts, and more particularly the present invention relates to a goalie hockey stick having a protruding finger guard supported on the paddle portion thereof.

BACKGROUND

A typical construction of a goalie stick in the sport of hockey is to include a generally flat blade portion for handling the puck at ice level, a generally flat paddle portion sloping upwardly from one end of the blade portion so as to lie generally in a common plane with the blade portion, and a handle portion extending upwardly from the top end of the paddle portion. A goalie will typically grip the goalie stick with one hand gripped about the handle portion at the junction of the handle portion and the paddle portion. In addition, goalies will typically place one or two fingers in overlapping arrangement over the front face of the paddle portion to enhance directional control of the paddle and blade portions of the goalie stick. Although the hand of the goalie that grips the stick is typically protect by a blocker-type glove, the blocker-type glove includes a large protective front face that is designed to provide optimal protection to the hand of the goalie from pucks that are incoming generally transversely to the plane of the paddle and blade portions of the goalie stick. In some instances however, pucks can be deflected upwardly along the front face of the paddle portion of the goalie stick, resulting in pucks which impact the glove behind the protective front face of the blocker-type glove, causing injury to the fingers of the goalie.

U.S. Pat. No. 9,101,804 by Corey Brenner, discloses one example of a gripping aid for a goalie hockey stick in which a rounded protrusion is provided on the front face of the paddle portion of the hockey stick to providing a gripping surface for the index finger of a goalie gripping the hockey stick. A finger of the goalie extending about the protruding gripping surface remains readily susceptible to injury.

SUMMARY OF THE INVENTION

According to one aspect of the invention there is provided a finger guard for use with a goalie hockey stick in which the goalie hockey stick comprises (i) a blade portion having a major front surface and a major rear surface which span a height of the blade portion between a flat bottom edge and an opposing top edge and which span a length of the blade portion in a longitudinal direction of the blade portion between a toe end and a heel end of the blade portion, (ii) a paddle portion having a major front face and a major rear face spanning a width of the paddle portion between opposing side edges of the paddle and spanning a height of the paddle portion between opposing top and bottom ends in which the paddle portion is joined at the bottom end of the paddle portion to the heel end of the blade portion such that the paddle portion lies approximately within a common plane with the blade portion, and (iii) a handle portion extending longitudinally outward from the top end of the paddle portion, the handle portion being reduced in width relative to the paddle portion, the finger guard comprising:

a guard body for being supported on the paddle portion of the goalie hockey stick in proximity to the top end of the paddle portion to protrude outwardly from the major front face of the paddle portion;

the guard body having a bottom face which is arranged to be oriented transversely to the common plane of the paddle portion and the blade portion so as to be nearer to perpendicular than parallel to said common plane.

According to a further aspect of the present invention there is provided a goalie hockey stick comprising:

a blade portion having a major front surface and a major rear surface which span a height of the blade portion between a flat bottom edge and an opposing top edge and which span a length of the blade portion in a longitudinal direction of the blade portion between a toe end and a heel end of the blade portion;

a paddle portion having a major front face and a major rear face spanning a width of the paddle portion between opposing side edges of the paddle and spanning a height of the paddle portion between opposing top and bottom ends;

the paddle portion being joined at the bottom end of the paddle portion to the heel end of the blade portion such that the paddle portion lies approximately within a common plane with the blade portion;

a handle portion extending longitudinally outward from the top end of the paddle portion, the handle portion being reduced in width relative to the paddle portion; and a finger guard comprising:

a guard body supported on the paddle portion of the goalie hockey stick in proximity to the top end of the paddle portion to protrude outwardly from the major front face of the paddle portion;

the guard body having a bottom face which is oriented transversely to the common plane of the paddle portion and the blade portion so as to be nearer to perpendicular than parallel to said common plane.

According to yet another aspect of the present invention there is provided a method protecting a finger of a user of a goalie hockey stick in which the goalie hockey stick comprises (i) a blade portion having a major front surface and a major rear surface which span a height of the blade portion between a flat bottom edge and an opposing top edge and which span a length of the blade portion in a longitudinal direction of the blade portion between a toe end and a heel end of the blade portion, (ii) a paddle portion having a major front face and a major rear face spanning a width of the paddle portion between opposing side edges of the paddle and spanning a height of the paddle portion between opposing top and bottom ends in which the paddle portion is joined at the bottom end of the paddle portion to the heel end of the blade portion such that the paddle portion lies approximately within a common plane with the blade portion, and (iii) a handle portion extending longitudinally outward from the top end of the paddle portion, the handle portion being reduced in width relative to the paddle portion, the method comprising:

providing a guard body having a bottom face; and supporting the guard body on the paddle portion of the goalie hockey stick in proximity to the top end of the paddle portion to protrude outwardly from the major front face of the paddle portion such that the bottom face is oriented transversely to the common plane of the paddle portion and the blade portion so as to be nearer to perpendicular than parallel to said common plane.

The transverse orientation of the bottom face of the guard body provides the function of deflecting pucks away from the fingers of the goalie even when pucks are deflected upwardly along the paddle portion of the goalie hockey stick.

The bottom face may be oriented perpendicularly to a longitudinal axis of the paddle portion.

The guard body preferably spans a majority of a full width of the paddle portion, or substantially the full width of the paddle portion.

The guard body preferably protrudes from the paddle portion (i) by a thickness corresponding approximately to a maximum thickness of the paddle portion, or (ii) by a thickness which is greater than a maximum thickness of the paddle portion.

The guard body is preferably spaced below a top end of the paddle portion.

The guard body may be formed seamlessly as a unitary body with the paddle portion of the goalie hockey stick in some embodiments.

More preferably, the guard body is removably supported on the paddle portion of the goalie hockey stick. In this instance, the finger guard may further include a collar supporting the guard body seamlessly as a unitary body thereon in which the collar is frictionally retained about the paddle portion of the goalie hockey stick by interference fit. Preferably the collar spans a greater height along the paddle portion of the goalie hockey stick than a height of the guard body between opposing top and bottom ends thereof. The bottom face is preferably oriented perpendicularly to a longitudinal axis of the collar.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
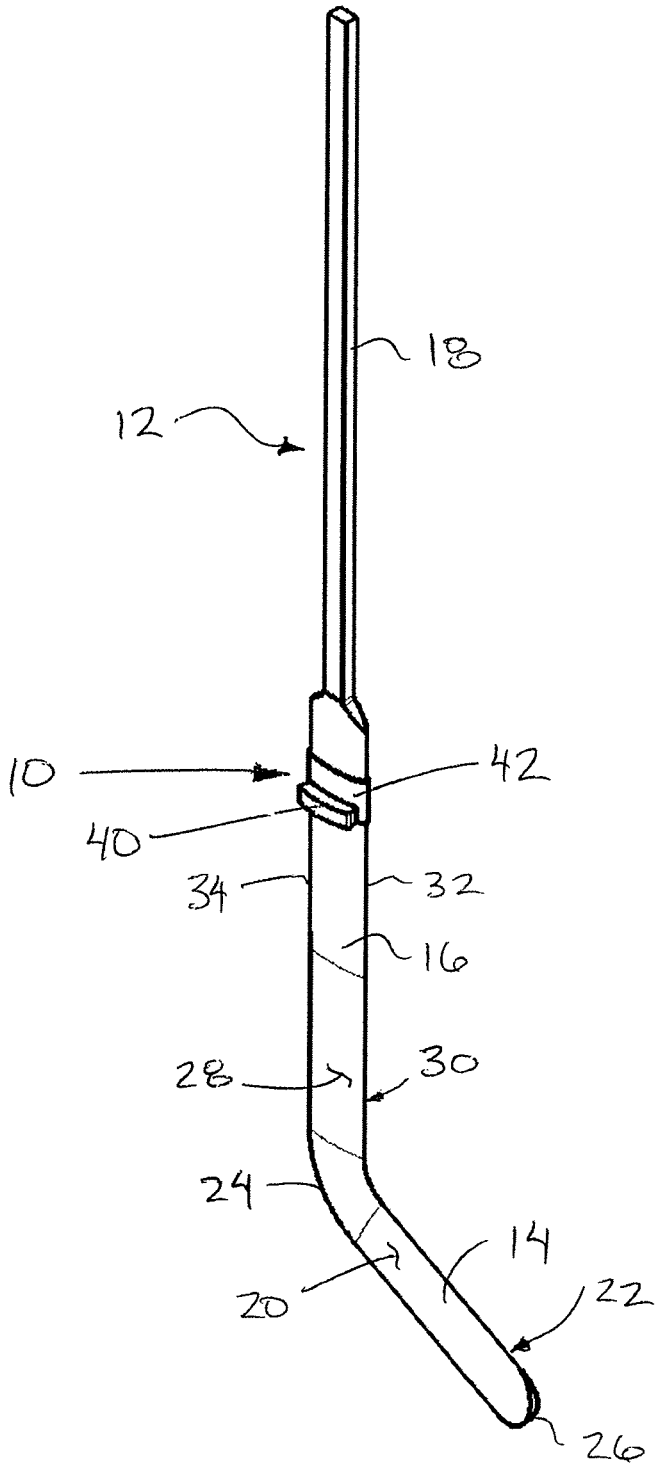
FIG. 1 is a perspective view of a goalie hockey stick supporting the finger guard according to the present invention thereon.
Figure 2:
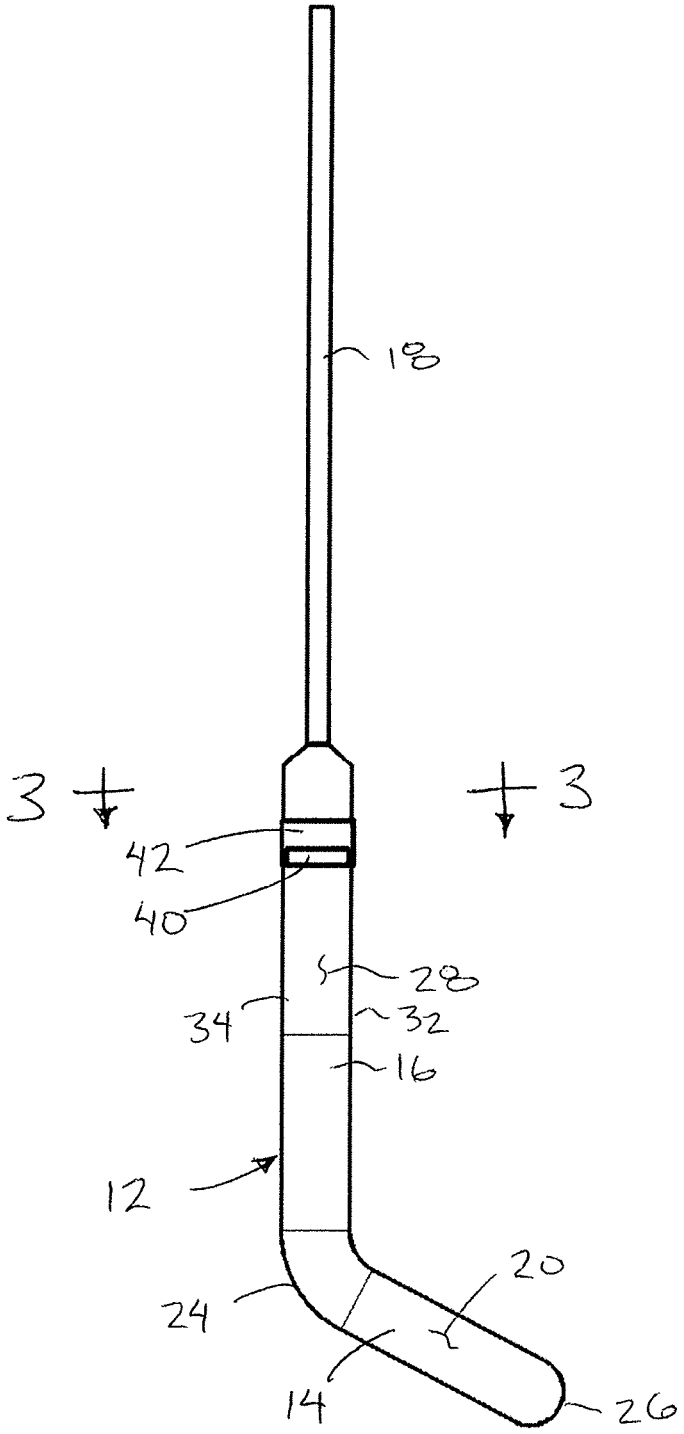
FIG. 2 is a front elevational view of the goalie hockey stick according to FIG. 1.
Figure 3:
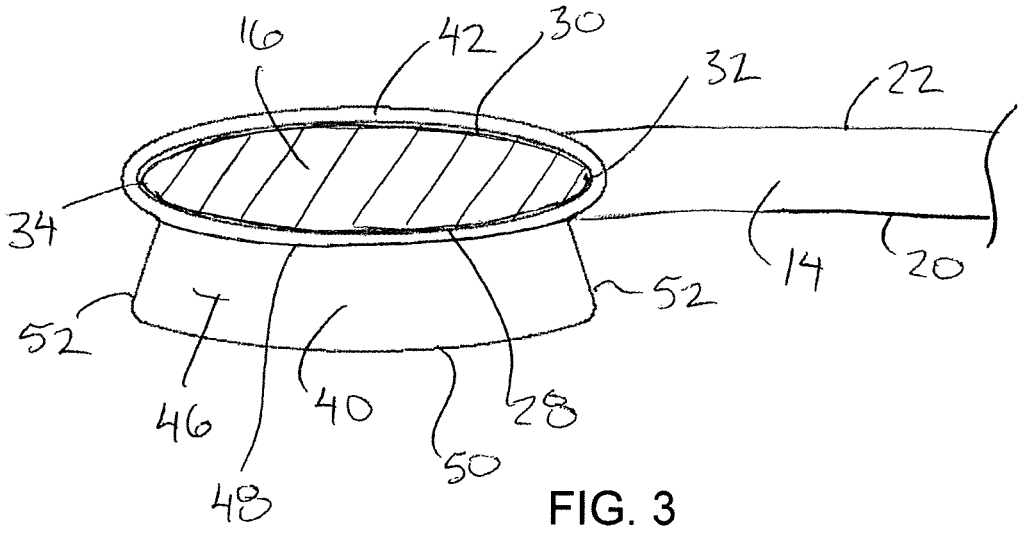
FIG. 3 is a sectional view along the line 3-3 in FIG. 2 corresponding to a top plan view of the finger guard shown mounted on the goalie hockey stick.
Figure 4:
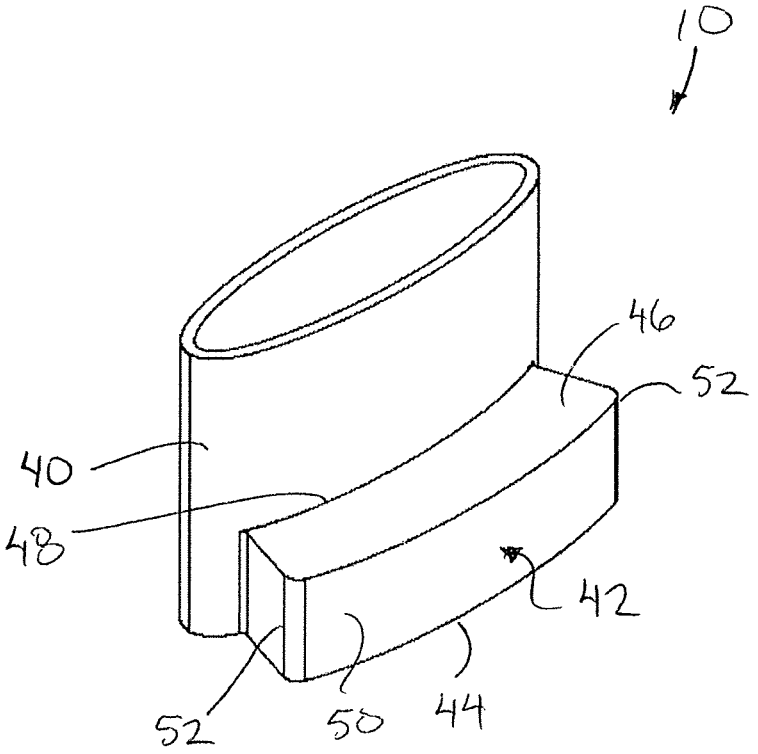
FIG. 4 is a perspective view of a top side of the finger guard removed from the goalie hockey stick.

Referring to the accompanying figures there is illustrated a goalie hockey stick finger guard generally indicated by reference numeral 10. The finger guard 10 is particularly suited for use with a goalie hockey stick 12 of the type used by goalies in the sport of hockey.

The finger guard 10 may be formed integrally with the goalie hockey stick at the time of manufacture, or may be mounted temporarily or permanently to the goalie hockey stick subsequent to manufacturing. In each instance, the finger guard provides protection to the fingers of the goalie by blocking hockey pucks which are directed upwardly along the goalie stick towards the hand of the goalie that grips the stick.

The goalie hockey stick 12 that the finger guard 10 is adapted for, generally comprises (i) a blade portion 14 that is intended to be used at ice level for handling the puck, (ii) a paddle portion 16 that extend upwardly from the blade portion, and (iii) a handle portion 18 that extends upwardly from the paddle portion and which is reduced in the lateral dimension relative to the paddle portion so as to be suitable for gripping in the hand of the goalie.

The blade portion 14 includes a major front surface 20 and an opposing major rear surface 22 which span substantially the full height of the blade portion between a bottom edge and a top edge of the blade portion, while also spanning the full length of the blade portion in the longitudinal direction thereof between a heel end 24 and a toe end 26 of the blade portion. The blade portion is typically generally flat; however, the blade portion may also be formed with a slight curvature such that the front surface 20 is slightly concave and the rear surface 22 is slightly convex. The bottom edge remains flat for engaging the ice surface in use. A plane of the blade portion is generally defined as connecting between the top and bottom edges of the blade portion and/or connecting between the heel end and the toe end of the blade portion.

The paddle portion 16 includes a major front face 28 and a major rear face 30 that each span laterally across the full width of the paddle portion between opposing inner and outer edges 32 and 34 which are generally parallel to one another. The major front face 28 and the major rear face 30 of the paddle portion also span substantially the full height of the paddle portion between a bottom end of the paddle portion connected to the heel end 24 of the blade portion and an opposing top end of the paddle portion which is spaced upwardly from the blade portion. The opposing inner and outer edges 34 collectively define a common longitudinal direction that the paddle portion extends from the bottom end to the top end thereof which is oriented to slope upwardly and outwardly from the bottom end of the blade portion. For example, an interior angle defined between the top edge of the blade portion and the inner edge of the paddle portion may be between 115 and 125 degrees.

Each of the front and rear faces 28 and 30 are shaped to be generally convex in profile between the opposing side edges 32 and 34 such that a maximum thickness of the paddle portion is defined at a laterally centred location between the inner and outer edges 32 and 34 along the full length of the paddle portion. The thickness between the front and rear faces is tapered and reduced towards each of the inner and outer edges 32 and 34.

The handle portion 18 has a cross-sectional shape which is generally rectangular in shape in which the thickness between front and rear sides of the handle portion is approximately equal to the maximum thickness of the paddle portion at the laterally centred location thereon. The width in the lateral direction between opposing side edges of the handle portion is much reduced relative to the paddle portion therebelow such that the width in the lateral direction of the handle portion is between one third and one quarter of the width of the paddle portion in the illustrated embodiment. The handle portion has a constant shape along the length of thereof in the longitudinal direction between a bottom end of the handle portion connected to the top end of the paddle portion and an opposing top end of the handle portion. The handle portion 18 has a respective longitudinal axis which is oriented to be generally coaxial with the longitudinal direction of the paddle portion 16 from which it extends.

The finger guard 10 generally includes (i) a guard body 40 which is supported on the goalie hockey stick in protruding relationship relative to the paddle portion 16 upon which it is supported, and (ii) a mounting body 42 which serves to removably support the guard body 40 on the paddle portion of the goalie hockey stick according to the illustrated embodiment. In this instance, the mounting body and the guard body are formed as a unitary, one-piece, integral body in which the mounting body and the guard body are seamlessly joined with one another while being formed of a single material which is consistent throughout the finger guard. Typically, the material forming the finger guard is a durable resilient material which can withstand puck impacts without cracking and which has some degree of resiliency such that it can be stretched onto the hockey goalie stick by interference fit in the preferred embodiment, while thicker portions of the body such as the guard body are more rigid to provide adequate protection to the finger of the user.

In the illustrated embodiment, the mounting body 42 comprises a boot or collar shaped body which is suitably shaped and sized to circumscribe the paddle portion of the goalie hockey stick with some slight circumferential stretching of the collar being required to position the mounting body over top of the paddle portion of the hockey stick. The mounting body is intended to be secured on the paddle portion of the hockey stick in proximity to the top end thereof at the junction of the handle portion and the paddle portion, while remaining spaced slightly below said junction such that the guard body supported by the mounting body is located on the blade portion at a location spaced below the top end of the paddle portion. The mounting body may be formed of a resilient gripping material having a high coefficient of friction, such as a rubber-like material, or more preferably a stiff yet somewhat resilient silicone material, such that the combination of the interference fit and the resilient gripping material are adequate to frictionally retain the mounting body at the desired mounting location along the paddle portion of the hockey stick.

Alternatively, adhesive hockey tape may be used to provide additional securement by overlapping the tape over the ends of the mounting body and the adjacent portion of the paddle portion of the hockey stick.

The guard body 40 is supported to protrude outwardly from the collar forming the mounting body so as to be substantially flush with the bottom edge of the collar at the bottom side of the guard body. The overall height of the guard body 40 is much less than the height of the collar forming the mounting body such that the mounting body spans a height along the paddle portion of the hockey stick which may be two or three times the height of the guard body 40.

Figure 5:
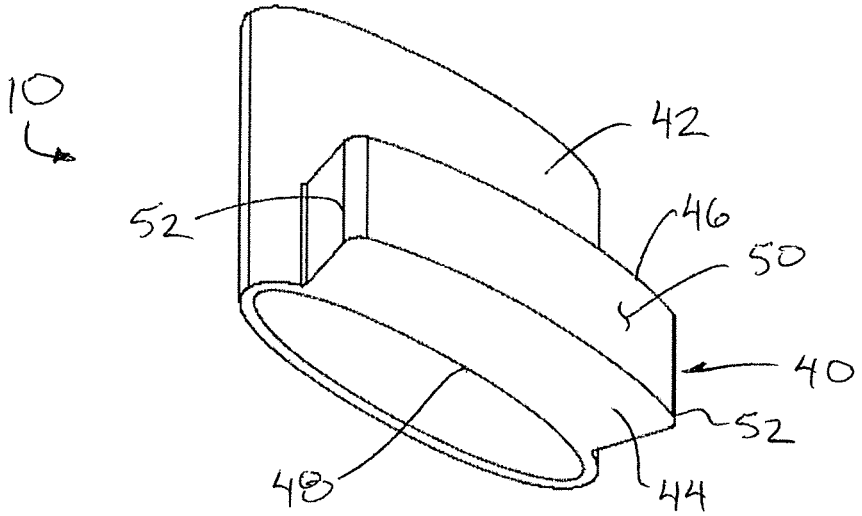
FIG. 5 is a perspective view of a bottom side of the finger guard.
Figure 6:
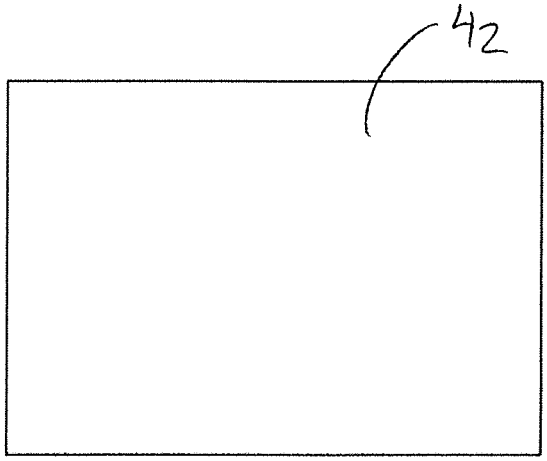
FIG. 6 is a rear elevational view of the finger guard.
Figure 7:
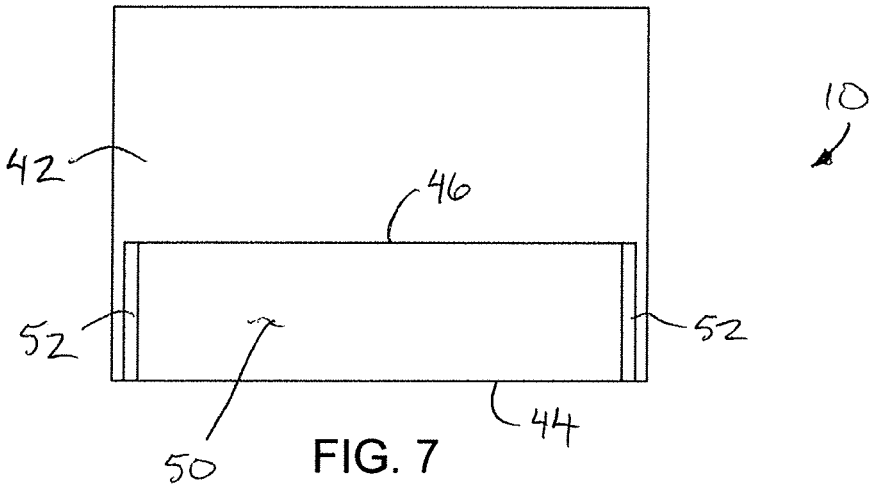
FIG. 7 is a front elevational view of the finger guard.
Figure 8:
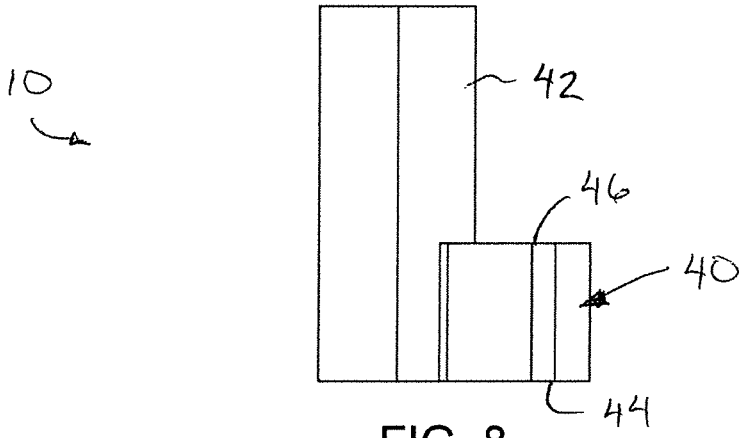
FIG. 8 is a side elevational view of the finger guard.
Figure 9:
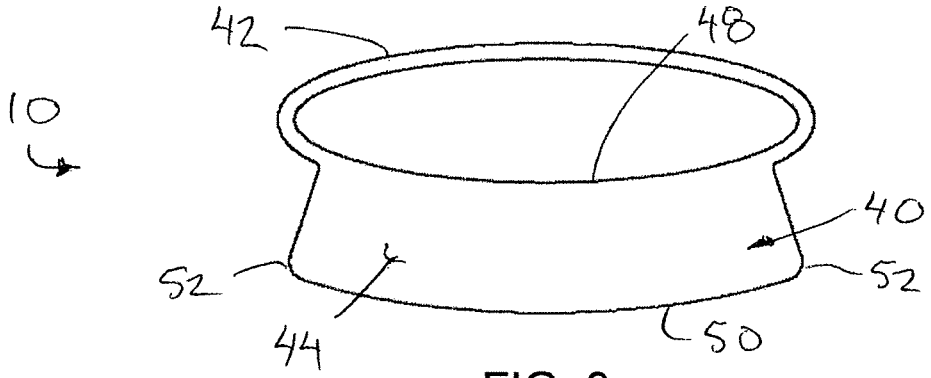
FIG. 9 is a bottom plan view of the finger guard.

The guard body 40 includes a bottom end face 44 and an opposing top end face 46 which are parallel to one another at opposing top and bottom ends of the guard body in the longitudinal direction of the paddle portion upon which the finger guard is supported. The end faces 44 and 46 comprises flat faces which are oriented generally perpendicularly to the longitudinal direction of the paddle portion of the goalie stick and perpendicularly to the plane of the paddle portion defined by the inner and outer edges thereof. As shown in FIG. 5, the bottom face 44 of the guard body 40 is uninterrupted and devoid of openings across the full width and the full thickness of the guard body. Although it is not required that the end faces be perpendicular, orientation of the bottom end face 44 so as to be nearer to perpendicular than parallel to the longitudinal direction of the paddle portion provides optimal function for deflecting any pucks riding up the paddle portion of the goalie stick to be deflected away from the fingers of the user.

The guard body 40 protrudes generally perpendicularly outwardly from the major front face 28 of the paddle portion from an inner side 48 to an outer side 50 which define the overall thickness of the guard body 40 therebetween. The overall thickness of the guard body in the illustrated embodiment is equal to or greater than the maximum thickness of the paddle portion of the goalie stick corresponding to the thickness of the handle portion. The outer side 50 follows the convex curvature of the front face 28 of the paddle portion across the full width thereof in the lateral direction between opposing ends 52 of the guard body 48.

The opposing ends 52 of the guard body extend outward from the inner side to the outer side of the body in a diverging relationship with one another such that the maximum width in the lateral direction of the guard body 40 is defined at the outer side 50 of the body. The overall width at the outer side 50 corresponds approximately to the overall width of the paddle portion 16 so as to be near or slightly less than the overall width defined between the inner and outer edges 32 and 34 of the paddle portion.

When providing the guard body 40 supported on a mounting body 42 having a collar shaped according to the illustrated embodiment, the guard body can be readily attached and removed from the goalie hockey stick as desired. More particularly, a goalie may choose to mount the guard body on the goalie stick only during practices, but can readily remove the guard body from the goalie stick for games for instance. Mounting the finger guard with the guard body 40 at the bottom edge thereof such that the collar of the mounting body 42 protrudes upwardly beyond the finger guard enables the fingers of the goalie in the hand gripping the goalie stick to overlap the upper portion of the collar above the guard body 40 if desired.

In further embodiments, the finger guard may be incorporated integrally in the manufacture of the goalie stick by forming the finger guard of the same material as the body of the goalie stick at the time of manufacture.

In yet further arrangements, the guard body 40 of the present invention may be formed as a separate piece which can be secured onto the paddle portion of the goalie hockey stick at the desired location using other fastening means including the use of fasteners penetrated through the body of the goalie stick or by the use of adhesive hockey tape for example.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A finger guard for use with a goalie hockey stick in which the goalie hockey stick comprises (i) a blade portion having a major front surface and a major rear surface which span a height of the blade portion between a bottom edge and an opposing top edge and which span a length of the blade portion in a longitudinal direction of the blade portion between a toe end and a heel end of the blade portion, (ii) a paddle portion having opposing side edges of the paddle portion that are oriented in a longitudinal direction of the paddle portion, a major front face and a major rear face, each of the major front face and the major rear face spanning a width of the paddle portion in a lateral direction of the paddle portion between the opposing side edges of the paddle portion and spanning a height of the paddle portion between opposing top and bottom ends in which the paddle portion is joined at the bottom end of the paddle portion to the heel end of the blade portion such that the paddle portion lies within a common plane with the blade portion, and (iii) a handle portion extending longitudinally outward from the top end of the paddle portion, the handle portion being reduced in width relative to the paddle portion, the finger guard comprising:

a collar arranged to be removably supported about the paddle portion of the goalie hockey stick in proximity to the top end of the paddle portion;

a guard body supported on the collar to protrude outwardly from the collar so as to be arranged to protrude outwardly from the major front face of the paddle portion;

the guard body being arranged to span a majority of a full width of the paddle portion;

the guard body having a bottom face which is arranged to be oriented perpendicularly to the longitudinal direction of the paddle portion; and the bottom face of the guard body fully spanning a width of the guard body corresponding to the lateral direction of the paddle portion and fully spanning a thickness of the guard body, said thickness corresponding to a direction that the guard body is arranged to protrude from the major front face of the paddle portion.

2. The finger guard according to claim 1 wherein the guard body spans the full width of the paddle portion.

3. The finger guard according to claim 1 wherein the collar is formed of resilient material arranged to be frictionally retained about the paddle portion of the goalie hockey stick by interference fit.

4. The finger guard according to claim 1 wherein the thickness that the guard body is arranged to protrude from the paddle portion is equal to or greater than a maximum thickness of the paddle portion.

5. The finger guard according to claim 4 wherein the thickness that the guard body protrudes from the paddle portion is equal to the maximum thickness of the paddle portion.

6. The finger guard according to claim 4 wherein the thickness that the guard body protrudes from the paddle portion is greater than the maximum thickness of the paddle portion.

7. The finger guard according to claim 1 wherein the guard body is arranged to be spaced below a top end of the paddle portion.

8. The finger guard according to claim 1 wherein the bottom face of the guard body is uninterrupted and devoid of openings fully across the width and fully across the thickness of the guard body.

9. A finger guard for use with a goalie hockey stick in which the goalie hockey stick comprises (i) a blade portion having a major front surface and a major rear surface which span a height of the blade portion between a bottom edge and an opposing top edge and which span a length of the blade portion in a longitudinal direction of the blade portion between a toe end and a heel end of the blade portion, (ii) a paddle portion having opposing side edges of the paddle portion that are oriented in a longitudinal direction of the paddle portion, a major front face and a major rear face, each of the major front face and the major rear face spanning a width of the paddle portion in a lateral direction of the paddle portion between the opposing side edges of the paddle portion and spanning a height of the paddle portion between opposing top and bottom ends in which the paddle portion is joined at the bottom end of the paddle portion to the heel end of the blade portion such that the paddle portion lies within a common plane with the blade portion, and (iii) a handle portion extending longitudinally outward from the top end of the paddle portion, the handle portion being reduced in width relative to the paddle portion, the finger guard comprising:

a collar arranged to be removably supported on the paddle portion of the goalie hockey stick in proximity to the top end of the paddle portion;

a guard body supported seamlessly as a unitary body on the collar such that the guard body is arranged to protrude outwardly from the major front face of the paddle portion;

the guard body being arranged to span a majority of a full width of the paddle portion;

the guard body having a bottom face which is arranged to be oriented perpendicularly to the longitudinal direction of the paddle portion;

the bottom face of the guard body fully spanning a width of the guard body corresponding to the lateral direction of the paddle portion and fully spanning a thickness of the guard body, said thickness corresponding to a direction that the guard body is arranged to protrude from the major front face of the paddle portion; and the collar being arranged to span a height along the paddle portion of the goalie hockey stick that is greater than a height of the guard body between opposing top and bottom ends thereof.

10. The finger guard according to claim 9 wherein the collar comprises a resilient material which is arranged to be frictionally retained about the paddle portion of the goalie hockey stick by interference fit.

11. The finger guard according to claim 9 wherein the bottom face of the guard body is uninterrupted and devoid of openings fully across the width and fully across the thickness of the guard body.

12. A finger guard for use with a goalie hockey stick in which the goalie hockey stick comprises (i) a blade portion having a major front surface and a major rear surface which span a height of the blade portion between a bottom edge and an opposing top edge and which span a length of the blade portion in a longitudinal direction of the blade portion between a toe end and a heel end of the blade portion, (ii) a paddle portion having opposing side edges of the paddle portion that are oriented in a longitudinal direction of the paddle portion, a major front face and a major rear face, each of the major front face and the major rear face spanning a width of the paddle portion in a lateral direction of the paddle portion between the opposing side edges of the paddle portion and spanning a height of the paddle portion between opposing top and bottom ends in which the paddle portion is joined at the bottom end of the paddle portion to the heel end of the blade portion such that the paddle portion lies within a common plane with the blade portion, and (iii) a handle portion extending longitudinally outward from the top end of the paddle portion, the handle portion being reduced in width relative to the paddle portion, the finger guard comprising:

a mounting body arranged to be removably supported on the paddle portion of the goalie hockey stick in proximity to the top end of the paddle portion so as to circumscribe the paddle portion;

a guard body supported on the mounting body to protrude outwardly from the mounting body so as to be arranged to protrude outwardly from the major front face of the paddle portion;

the guard body being arranged to span a majority of a full width of the paddle portion;

the guard body having a bottom face which is arranged to be oriented perpendicularly to the longitudinal direction of the paddle portion; and the bottom face of the guard body fully spanning a width of the guard body corresponding to the lateral direction of the paddle portion and fully spanning a thickness of the guard body, said thickness corresponding to a direction that the guard body is arranged to protrude from the major front face of the paddle portion.

* * * * *